US005121523A

United States Patent [19]

Brutsch et al.

[11] Patent Number: 5,121,523

[45] Date of Patent: Jun. 16, 1992

[54] METERING METHOD AND METERING APPARATUS FOR DISPENSING PREDETERMINABLE QUANTITIES OF FIBER FLOCKS

[75] Inventors: Peter Brutsch, Neuhausen; Paul Staheli, Wilen b. Wil; Robert Demuth, Nurensdorf; Jurg Faas, Dinhard, all of Switzerland

[73] Assignee: Machinenfabrik Rieter AG, Winterthur, Switzerland

[21] Appl. No.: 480,123

[22] Filed: Feb. 14, 1990

[30] Foreign Application Priority Data

Feb. 14, 1989 [DE] Fed. Rep. of Germany ..... 3904390
Apr. 27, 1989 [DE] Fed. Rep. of Germany ..... 3913997

[51] Int. Cl.[5] ..... D01B 1/00

[52] U.S. Cl. ..... 19/97.5; 19/300; 222/1; 222/63; 222/64

[58] Field of Search ..... 222/52, 64, 65, 132, 222/135, 138, 142, 271, 272, 281, 312, 317, 410, 414, 502, 504, 1, 63; 19/97.5, 105, 240, 300; 198/782, 784

[56] References Cited

U.S. PATENT DOCUMENTS

| | | | |
|---|---|---|---|
| 3,448,905 | 6/1969 | Heilbrunn | 226/44 |
| 3,889,319 | 6/1975 | Roberson | 19/145.5 |
| 4,476,611 | 10/1984 | Keller et al. | 222/57 |
| 4,574,433 | 3/1986 | Brunnschweiler | 19/105 |
| 4,682,388 | 7/1987 | Pinto | 19/105 |
| 4,709,451 | 12/1987 | Leifeld | 19/240 |
| 4,939,816 | 7/1990 | Schenkel et al. | 222/56 |

FOREIGN PATENT DOCUMENTS

| | | | |
|---|---|---|---|
| 275471 | 7/1988 | European Pat. Off. | 19/105 |
| 1946213 | 2/1971 | Fed. Rep. of Germany . | |
| 2359917 | 6/1974 | Fed. Rep. of Germany . | |
| 3110668 | 9/1982 | Fed. Rep. of Germany . | |
| 3535684 | 4/1987 | Fed. Rep. of Germany . | |
| 3713590 | 10/1987 | Fed. Rep. of Germany . | |
| 3636381 | 5/1988 | Fed. Rep. of Germany . | |
| 3705148 | 9/1988 | Fed. Rep. of Germany . | |
| 3733632 | 4/1989 | Fed. Rep. of Germany . | |
| 1270586 | 7/1961 | France . | |
| 2588282 | 10/1985 | France . | |
| 640957 | 1/1984 | Switzerland . | |
| 1270670 | 4/1972 | United Kingdom . | |
| 2204068 | 4/1987 | United Kingdom . | |

OTHER PUBLICATIONS

Article in Textil Praxis International 1983, "Kontinuierlich arbeitende Spinnereivorbereitungsanlage mit Mikroprozessorsteuerungs- und Regelsystem".

*Primary Examiner*—Kevin P. Shaver
*Assistant Examiner*—Philippe Derakshani
*Attorney, Agent, or Firm*—Burns, Doane, Swecker & Mathis

[57] ABSTRACT

A metering method or a metering apparatus for dispensing predeterminable quantities of fiber flocks per unit time by two feed rollers (18, 20; 18.1, 18.2, 170, 172) which are arranged at the lower end of a flock shaft (14, 14.1, 14.2), which are rotatable in opposite directions and which form a conveying gap between them, with an opening roll (22; 22.1, 180) preferably being arranged beneath the feed rollers, is characterized in that at least one of the feed rollers is biased in the direction of the other feed roller (18; 20.1; 170) and is movable away from the latter under the pressure of the flocks; in that the spacing (x) between the two feed rollers, or a value proportional to this distance is measured; and in that the speed of rotation of at least one of the feed rollers is so regulated that the product (n·x) of the speed and of the spacing remains constant, at least on average.

25 Claims, 7 Drawing Sheets

METERING METHOD AND METERING APPARATUS FOR DISPENSING PREDETERMINABLE QUANTITIES OF FIBER FLOCKS

The present invention relates to a metering method and also a metering apparatus for dispensing predeterminable quantities of fiber flocks per unit time through the space between two feed means (e.g. rollers) which are arranged at the lower end of a flock chute, which are rotatable in opposite directions and which form a conveyor gap between them.

Methods and apparatus for dispensing fiber flocks are disclosed in British patent specification 735 172 or in the corresponding Swiss patent specification 313 355. A somewhat similar process and apparatus is disclosed in DE-OS 37 13 590 with an opening roll being additionally arranged beneath the feed rollers. Further examples can furthermore be found from German patent specification 196 821, from German patent specification 31 51 063 and from the Japanese specification 62-263327.

In the manufacture of yarns it is usual to form mixtures of different fibrous components, i.e. fibers of different origins, sorts, qualities, colors or other features, in order to generate fiber mixtures which are subsequently carded and supplied to further spinning processes.

The mixing can for example take place in such a way that the different types of fiber are filled into respective filling chutes and are deposited by means of feed rollers arranged at the lower ends of the fiber chutes onto a conveyor band which is circulating beneath the chutes. In this way a continuous layer structure arises on the conveyor element which is then supplied to an opening roll, with this opening roll separating individual flocks out of the flock structure and serving for good through-mixing of the different fibers of the different layers. By controlling the speed of rotation of the individual feed rollers it is possible to determine the respectively desired proportions of the individual fiber components.

One endeavors to so control the filling level of the fiber flocks in the individual chutes that this filling level remains approximately constant, so that with a constant filling level and a predetermined speed of rotation of the feed rollers the respectively desired quantities of fiber can be metered onto the recirculating conveyor band.

With this known metering method, or this known metering apparatus, one only succeeds to a restricted degree in attaining the respectively predetermined metered quantities. The previously known pieces of apparatus only take account relatively inaccurately of fluctuations in the density, in the filling level and the degree of opening of the fiber flocks.

As a result of this inaccuracy weighing feeders have also been proposed with the individual components being weighed prior to the mixing. These pieces of apparatus are however relatively complex. An objective underlying aspects of the present invention is to further develop a method and an apparatus of the initially named kind in such a way that a high metering accuracy can be attained with a favorable cost of manufacture, and indeed without the filling level in the flock chute having to be precisely predetermined.

In accordance with the present invention, there is provided a method which is characterized in that at least one of a pair of opposed feed means (e.g. rollers) is biased in the direction of the other feed means (e.g. roller) of the pair and is movable away from the latter under the pressure of the flocks; in that the spacing between the two feed means (e.g. rollers), or a value proportional to this distance is measured; and in that the speed of rotation of at least one of the feed means (e.g. rollers) is so regulated that the product of the speed and of the spacing remains constant, at least on average.

Instead of keeping the conveyor gap constant and of attaining the metering solely by presetting the speed of rotation of the feed rollers, the solution of the invention exploits the different density, pressure and degree of opening of the fibers in order to change the spacing between the feed rollers, i.e. the width of the conveyor gap, and then takes account of this change of the conveyor gap in the regulation of the speed of rotation of the feed rollers. In other words the method of the invention is so laid out that the width of the conveyor gap automatically adapts to the prevailing characteristics of the flocks in the filling chute, with the resulting width of the conveyor gap then being taken into account in the subsequent regulation of the speed of rotation of the feed rollers. In this way the metering apparatus automatically determines the respective characteristics of the fiber flocks and corrects the regulation of the speed of rotation of the feed rollers. In this way the desired value of the desired instantaneous production (flock weight per unit of time) can be maintained.

The method can be carried out very sensitively so that the metered quantities can be extremely accurately predetermined and the resulting fiber mixtures can always be held in the desired range of tolerances.

A preferred embodiment of the method of the invention is characterized in that the speed of regulation is so effected that the product of the speed of rotation and of the spacing is integrated over a predeterminable time interval; in that the instantaneous production $$m = \frac{K \int_{t_2}^{t_1} n \cdot x \cdot dt}{t_2 - t_1}$$

is formed herefrom, with K representing a constant; in that a comparison is effected between the actual value m of the instantaneous production and its desired value $m_{des}$; and in that from this a new speed value is calculated for the next time interval in the sense of an approximation of the next value of the instantaneous production m to its desired value.

In this process the regulation of the metering method is continuously corrected on the basis of the historical values measured in the last time interval. Thus a certain overproduction or a shortfall in production in the previous interval is corrected in the next interval, with such short term fluctuations having no notable effects on the end result of the mixing process since they are balanced out by the subsequent through-mixing.

In order to make the regulation simple the speed of rotation of the reed rollers is regulated to a respective constant value within each time interval.

For carrying out the method a metering apparatus in accordance with the invention is preferably characterized in that the axis of rotation of the one feed roller is mounted for displacement in the direction towards the axis of rotation of the other feed roller and for displacement away from the latter and is biased in the direction of the rotational axis of the other feed roller; in that a distance measuring device is provided which determines the spacing which results between the two feed rollers in operation of the flock conveyor, or a value proportional to this distance: and in that a regulating device is provided which regulates the speed of rotation of the feed rollers as a result of the distance which is determined in the sense of obtaining a predetermined desired value $m_{des}$ for the instantaneous production m.

The guidance of the displaceable feed roller can be achieved at favorable cost when the axle of rotation of the displaceable feed roller is carried from the axle of rotation of the opening roll, or of another roller, by means of two arms which are journalled on the axle of rotation of the opening roll (or of the other roller).

The bias of the one feed roller in the direction of the other feed roller preferably takes place by means of at least one spring, in particular by means of a spring the force of which remains at least substantially constant within the envisaged path of displacement. Two springs can be expediently provided which respectively act on one of the named arms. The use of springs, in particular of compression coil springs, and the mounting of the displaceable feed roller on said arms on which the springs can also act, represent very cost-favorable measures which nevertheless operate reliably and lead tc a favorably priced solution of the object underlying the invention. Should the spring force change substantially within the envisaged path of displacement then the spring characteristics can be taken into account in the regulating circuit and the regulation can be correspondingly corrected.

A particularly preferred favorable low cost solution consists in providing the spring in the form of a gas pressure spring, since such gas pressure springs are able to generate a substantially constant bias force over a relatively long stroke.

It is however not absolutely essential to use springs. One could for example also think of bias devices which are hydraulically or pneumatically urged and which for example contain pressure regulating valves so that the bias force always remains constant. Preferred bias means are set forth in the subordinate claims 7, 18, 19 and 20.

In a preferred embodiment adjustable abutment means are preferably provided which determine the minimum spacing between the feed rollers, i.e. the minimum width of the conveying gap. The abutment means preferably cooperate with said arms and restrict their range of pivoting.

With the metering apparatus of the invention it is not absolutely essential that the filling level of the flocks present in the chute is predetermined. A better result can however be achieved if a means is provided for keeping the filling level of the flocks present within the chute within predeterminable upper and lower limits. In this way one can in all cases prevent the conveyor gap being only inadequately filled with fiber flocks due to the chute becoming empty, and can thus prevent inaccuracy of the flock metering occurring.

The exceeding of the upper limit and falling short of the lower limit can be detected by means of light barriers, with the use of a light barrier for regulating the discharge speed of the opening machine which fills the chute already being known from CH-PS 313 355.

In accordance with a particularly preferred embodiment the means which determines the filling level is provided at the upper end of the chute and feeds flocks into the chute from a buffer chamber arranged above these means.

The means which determine the filling level is itself preferably a metering apparatus comprising two feed rollers and an opening roll, with this metering apparatus being regulated in accordance with the previously described metering apparatus or the previously described metering method.

The invention will now be explained in more detail with reference to the drawing in which are shown:

In all embodiments the same parts are designated with the same reference numerals, however with a decimal point when deviations arise relative to the previously described parts.

Figure 1:
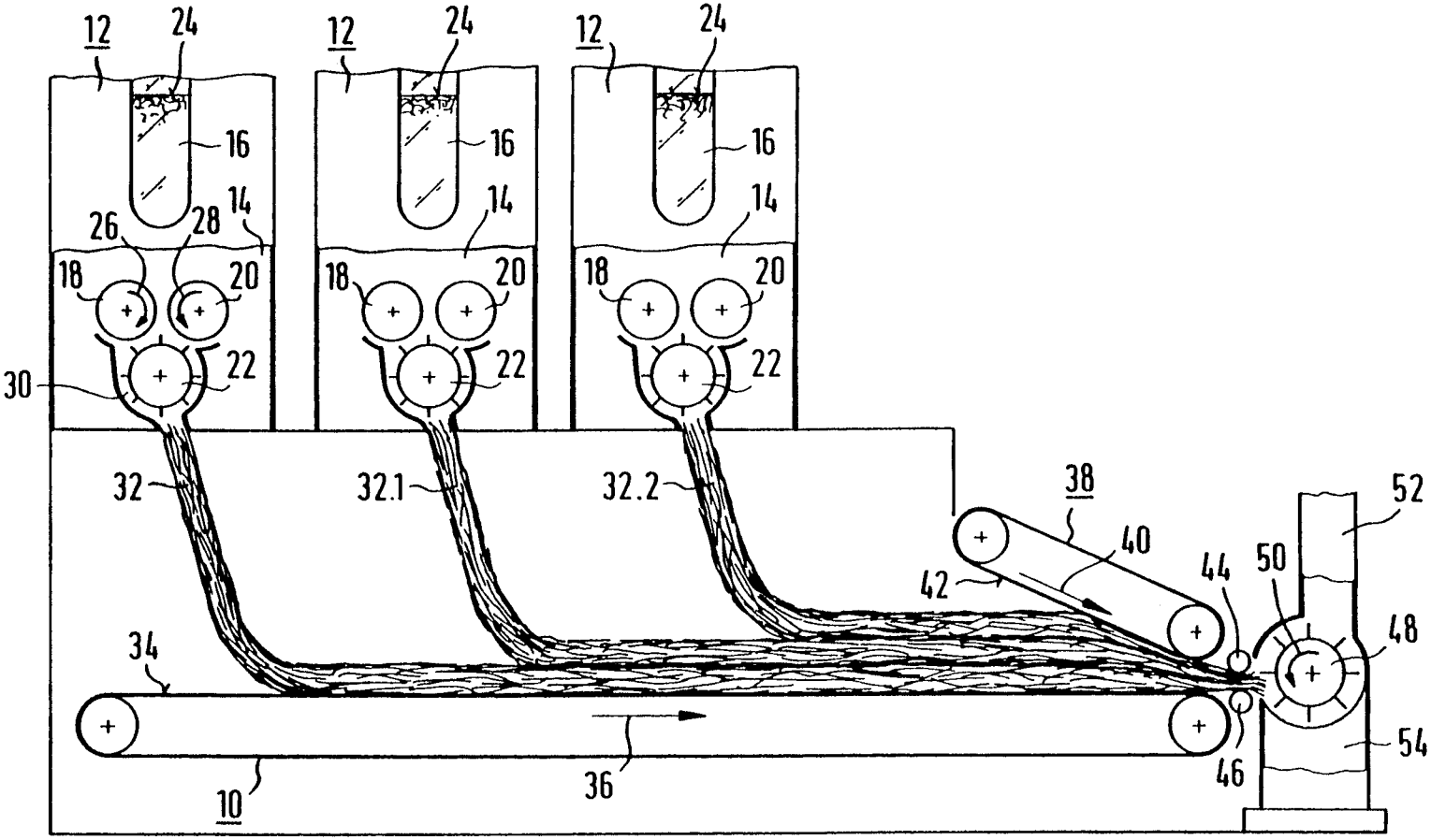
FIG. 1 is a schematic sideview of a mixing plant, which is equipped with three metering devices in accordance with the invention.
Figure 9:
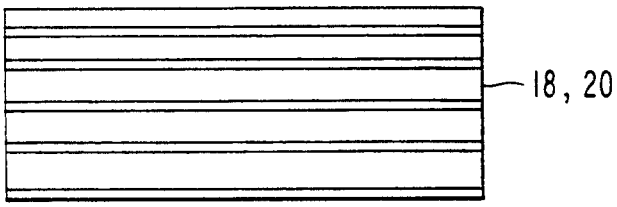
FIG. 9 is a top plan view of a feed roller illustrating one possible outer surfaces configuration.

The mixing device of FIG. 1 comprises a recirculating conveyor band 10 and three identically constructed metering apparatuses 12 which are arranged in a row above the conveyor band 10. Each metering apparatus comprises, as will be subsequently explained, of a filling chute 14 with a viewing window 16, of two to three feed means 18, 20 arranged at the lower end of the chute, and also of an opening roll 22. Each of the feed means 18 and 20 may be a feed roller which preferably has a surface configuration (i.e. longitudinal grooves at the surface (see FIG. 9) or other surface conditions such as a plurality of convex bumps or sandy or gritty surface portions) for contacting the flocks, and reference will be made hereinafter to "feed rollers". However, it will be understood that other forms of feed means, such as conveyor bands may be used instead of one or both of the rollers 18 and 20 if desired. For example, the feeding may be accomplished by one feed roller disposed in opposition to and cooperating with a conveying band. Also, the feeding may be accomplished by a driven roller or conveying band cooperating with a sheet metal guide to feed the flocks through the space between the surfaces of the driven element and the guide.

The flocks present in the chute, which have an upper limit at 24, are engaged by the feed rollers 18 and 20 which rotate in the respective directions 26 and 28. The filling height 24 of the flocks in the chute is not predetermined in this embodiment. The flocks are thereby fed through the conveyor gap formed between these two rollers towards the opening roll 22. The latter rotates faster than the feed rollers and separates flocks out of the supplied wad of flocks and feeds them in the form of opened loose flocks 32 through a duct 30 onto the upper run 34 of the conveyor band.

The loose fleeces or collections of flocks 32.1 and 32.2 from the two further metering apparatuses are laid in layers onto the layer formed by the first bundle of flocks 32 and are guided by the upper run of the conveyor band 34 in the direction of the arrow 36 to the right hand end of the mixing device in FIG. 1. Here a further recirculating conveyor band 38 is provided which runs in the direction of the arrow 40 and the lower run 42 of which is inclined in the conveying direction 36 towards the upper run 34 of the conveyor band 10. Thus the three layers 32, 32.1 and 32.2 are compressed and are subsequently captured in the conveying gap of two feed rollers 44, 46. The feed rollers 44, 46 feed the so formed layer structure to an opening roll 48 which rotates in the direction of the arrow 50 and releases the flocks from the layer structure and transfers it via chute or shaft 52 for further processing.

Any contamination or waste separated out by the opening process effected by the opening roll 48 is collected in the waste chamber 54 and can optionally be removed from here by means of a flow of air.

It will be understood that the embodiment shown in FIG. 1 is not restricted to three metering devices 12, but that any desired number of layers could be arranged above the conveyor band 10.

Figure 2:
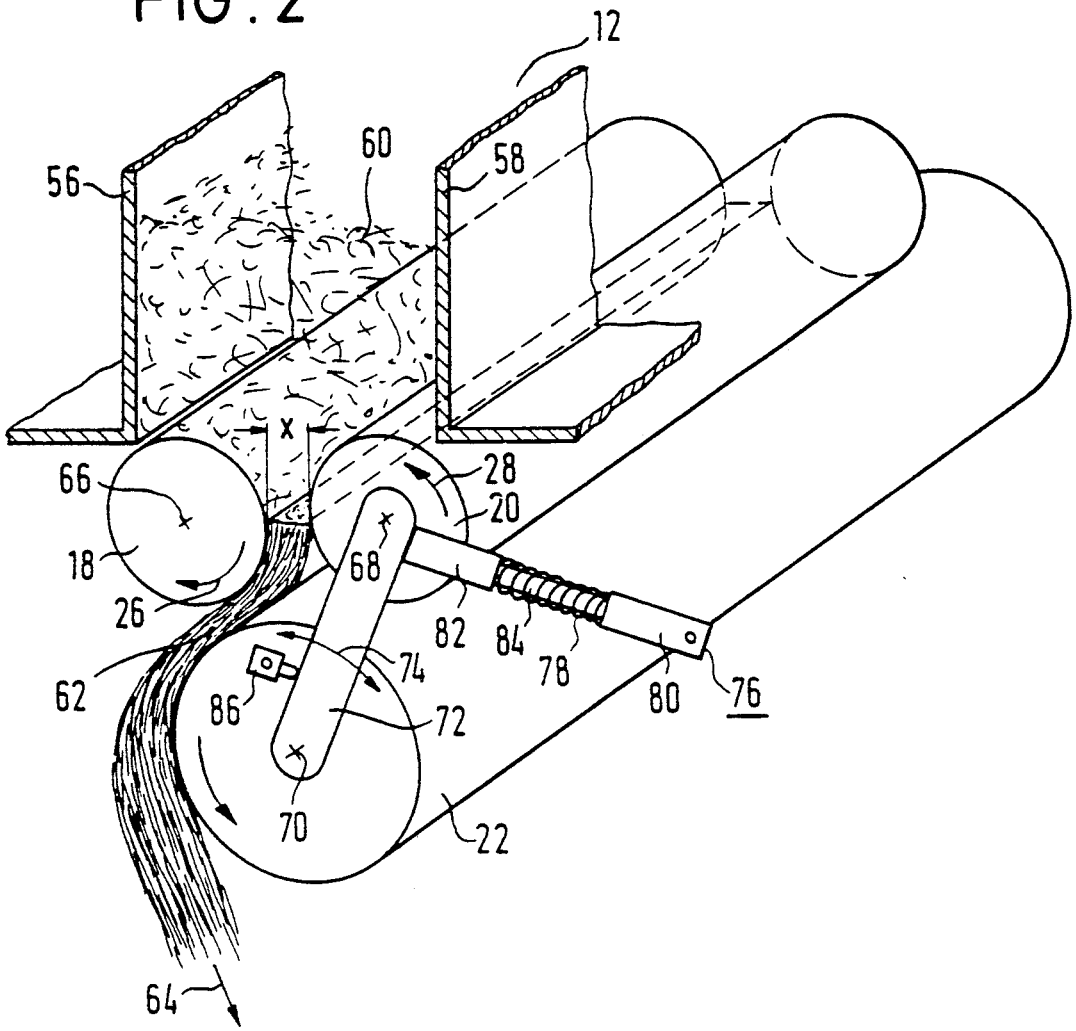
FIG. 2 is a perspective illustration of two feed rollers and an opening roll of a metering apparatus in accordance with the invention.

The practical embodiment of the feed rollers 18, 20 and of the opening roll 22 can be seen somewhat more readily from FIG. 2.

The two sidewalls 56, 58 of the flock chute extend close up to the surfaces of the feed rollers 18 and 20 respectively and diverge slightly from one another so that the flocks do not jam up. The flocks 60 in the chute 12 which have a high degree of opening are engaged by the feed rollers 18 and 20 which are rotating in the opposite directions as shown by the arrows 26, 28, and are compressed to a mat of flocks 62 The opening roll 22 then separates the flocks out of this wad of flocks and forms a flow of flocks which move on further in the direction of the arrow 64 in the direction of the conveyor band. All the flocks which are engaged by the feed rollers rotating with the speed of rotation n are transported through a conveyor gap, the width x of which represents the smallest spacing between the two feed rollers and the length of which corresponds to the length of the feed rollers or to the width between the sidewalls of the chute.

The axle of rotation of the feed roller 18 is characterized by 66, the axle of rotation of the feed roller by 68 and the axis of rotation of the opening roll 22 by 70. The axle of rotation 66 of the feed roller 18 is fixedly arranged in the flock chute in just the same way as the axle of rotation 70 of the opening roller 22. The axle of rotation 68 of the feed roller 20 is however carried by two arms of which only one can be seen in FIG. 2. The second arm 72 is located at the other end face of the feed roller 20 and is laid out in precisely the same manner as the illustrated arm 72. This arm 72 is journalled on the axle of rotation of the opening roll 22 and can thus execute pivotal movements about this axle of rotation 70 in the direction of the double arrow 74. As can be seen such movements lead to a change of the spacing x. A bias means 76 is provided on the right hand side of FIG. 2, and indeed in the form of a bias spring 78 which contacts at its one end against an abutment 80 fixedly arranged on the filling chute and at its other end against an abutment 82 which is connected to the arm 72. A bar 84 extends between the abutment 76 and the abutment 82 and is displaceably arranged within the abutment 82. It will be understood that a second bias means 76 is provided at the other end face of the feed roller 20 and there likewise presses against the associated arm 72. The two springs 78 thus attempt to make the distance x smaller. The minimum distance x is preset by an abutment means 86 which cooperates with the illustrated arm 72. A further abutment means 86 is located at the other end face of the feed roller 20 and operates in corresponding manner with the arm 72 which is located there.

The abutment 86 restricts the pivotal range of the arm 72 (in the anticlockwise direction in FIG. 2) and is quite simply a mechanical stop attached to the machine frame which prevents further pivotal movement of the arm 72 and thus further movement of the roller 20 towards the roller 18. Thus the abutment 86 determines the minimum size of the distance x.

It is preferred that the abutment 86 be constructed to permit adjustment of the minimum distance x. For example, the component for actually contacting the arm 72 may be the end of a threaded bolt adjustably positioned in a locknut means fixed with respect to the machine frame. The abutment 86 is not adjusted during operation of the machine.

A preferred form for the transducer is an electromagnetic displacement transducer of the type sold by Electro Corporation of Sarasota, Fla. 33578, U.S.A., under the trademark ELECTRO-MIKE EMS T and designated as Model PAD 1213. The transducer is located inside the abutment 82 and cooperates with the end of rod 84 slidable therein to sense the position of the rod 84 relative to the abutment 82 and therefore to assess the spacing x between the rollers 18 and 20.

Other arrangements of the transducer also are feasible. For example, an electro-magnetic transducer of the type indicated above may be mounted similarly to the abutment 86 but spaced from the arm 72, so that the arm 72 forms the counterelement (target) for the transducer (probe). If necessary, the displacement measured by the transducer can be scaled to determine the distance x (e.g. if the transducer is positioned halfway along the arm 72 the scale factor would be 2.)

The spacing x adjusts itself in operation depending on the pressure prevailing in the conveying chute, on the density and on the degree of opening of the flocks and on the force of the spring 78. The size of the spacing x can be determined through the path of displacement of the bar 84 within the abutment 82. The bar 84 and the abutment 82 are formed as a path measuring transducer.

The metering method of the invention and the regulation which is carried out will subsequently be explained with reference to FIG. 3.

First of all the following definitions are introduced:

m = mass;
t = time;
m = mass flow = the relative production of a metering apparatus
apparatus = mass/time;
v = volume = volume/time; $\rho$ = material density; n = speed of rotation of the feed rollers;
u = peripheral speed of the feed rollers;
d = diameter of the feed rollers;
l = length of the feed rollers;
A = opening cross-section of the conveying gap = l·x;
x = variable width of opening of the conveying gap;
s = transport length.

The mass flow equal to the instantaneous production m is equal to $v \cdot \rho$.

Taking account of the above definitions one can also derive the following equation:

$$m = v \cdot \rho = \frac{v}{t} \cdot \rho = \frac{A \cdot s}{t} \cdot \rho = \frac{l \cdot x \cdot s}{t} \cdot \rho$$

-continued $$m = \frac{l \cdot x \cdot u \cdot t}{t} \cdot \rho = l \cdot x \cdot d \cdot \pi \cdot n \cdot \rho$$

Now, $\rho$ here represents the material density in the conveying gap and this is at least substantially constant as a result of the bias with a substantially constant force. Since d, $\pi$ and 1 are also constant with can write:

$$\rho \cdot d \cdot \pi \cdot 1 = K$$

Furthermore $m = dm/dt = k \cdot n \cdot x$, i.e., $dm = K \cdot n \cdot x \cdot dt$, from which we can calculate $$m = K \int_{t_1}^{t_2} n \cdot x \cdot dt$$

with the instantaneous production over a time interval $t_2 - t_1$ being written as follows:

$$m = \frac{K \int_{t_1}^{t_2} n \cdot x \cdot dt}{t_2 - t_1}$$

with a constant interval being preferably chosen for $t_2 - t_1$ in accordance with the invention.

Figure 3:
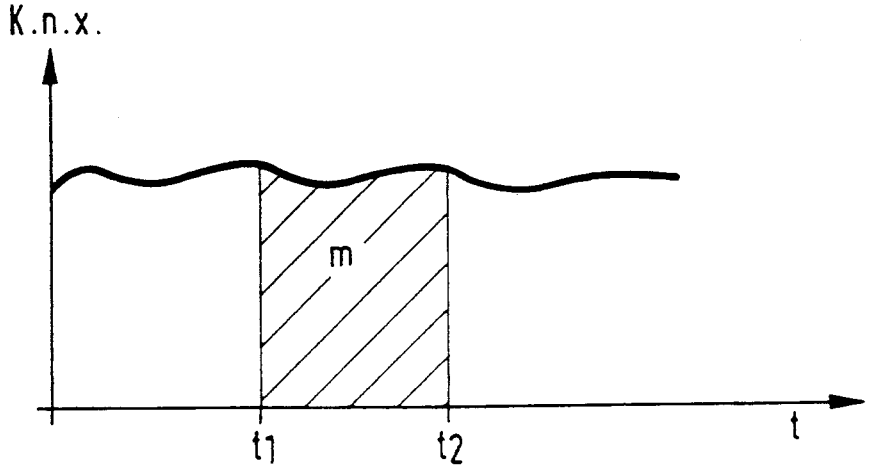
FIG. 3 is a graphic representation to explain the regulating process.

As a result of the graphical representation of FIG. 3 one can see that the mass m actually corresponds to the area beneath the curve $n \cdot x = f(t)$ in the time interval $t_2 - t_1 \cdot m$ here represents the averaged value in this time interval.

The regulation of the speed of rotation of the feed rollers is now effected as follows:

First of all the cross-section of the opening is determined and is integrated over the fixed time interval $t_2 - t_1$ at a speed of rotation $n_1$ which is constant throughout the measurement from which the instantaneous production $m_1$ results. The computation for the instantaneous production can be carried out pursuant to the foregoing equations by a microprocessor which knows the constant parameters and which is supplied with the continuous measurement results of the path measuring transducer and the speed of rotation of the feed rollers 18 and 20.

This computed value is compared with the desired production $m_{des}$ and the regulation of the speed of rotation is so effected that a new speed of rotation $n_2$ results which remains constant for the next time interval. More particularly, the calculation of the average instantaneous production over a time interval $t_2 - t_1$ results in a determination of the average value of x for that time interval. By treating this average value as a constant, and using the desired value for production, the computer can calculate a new desired speed for the next time interval. The speed of the roller is regulated in accordance with this new value, and the instantaneous production is then measured for that next time interval. This process is repeated time interval for time interval with the regulation rapidly adjusting to the desired mean production value $m_{des}$.

The regulation of the roller speed n can be effected in any well-known manner. For example, the computer can apply the computed value for the desired roller speed to a suitable conventional regulator circuit. Alternatively, the computer can directly regulate the speed of the roller by means of a conventional proportional-differential regulation algorithm or the like.

Figure 4:
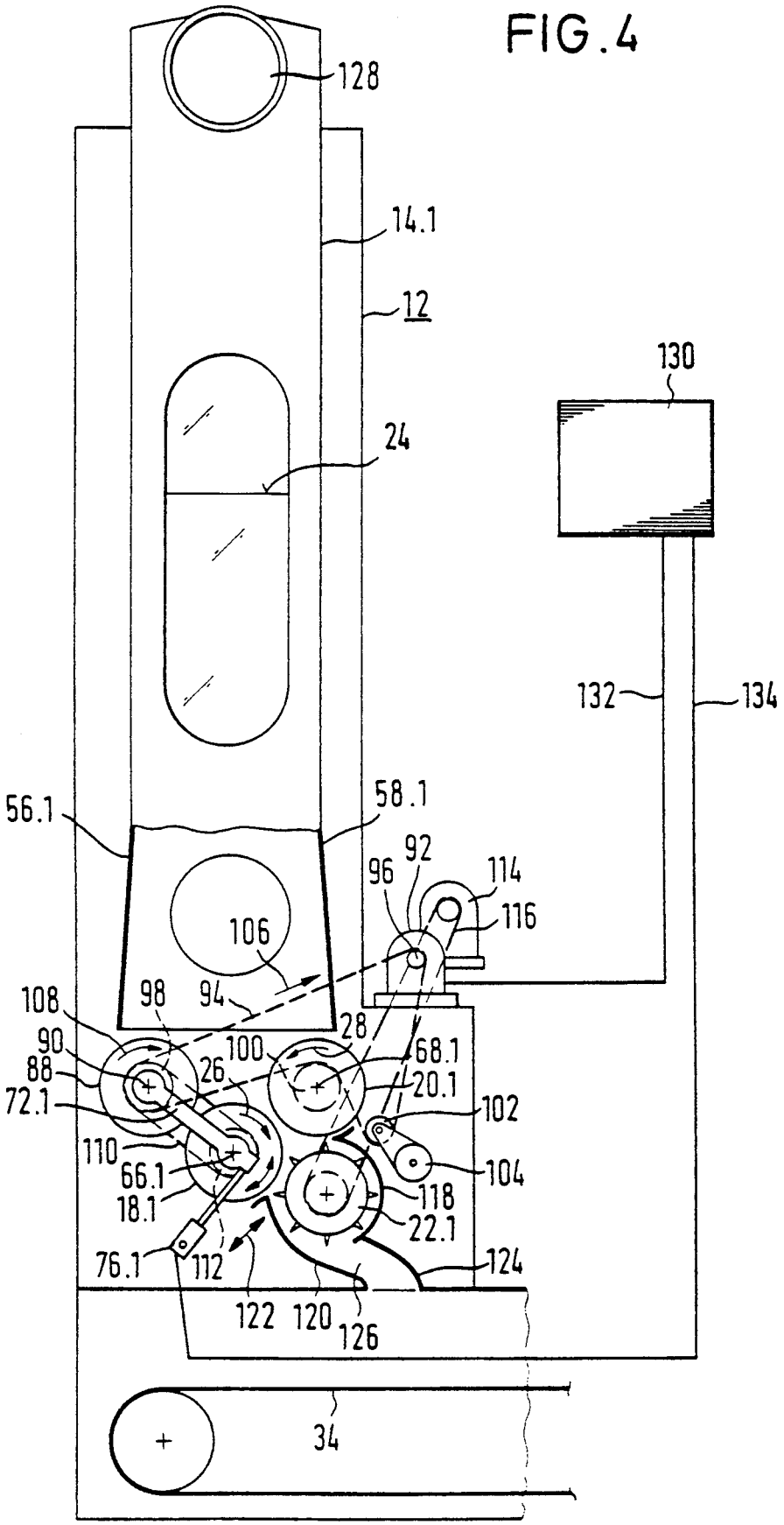
FIG. 4 is a sideview of a first detailed embodiment of a metering apparatus in accordance with the invention.

The drive for the different rollers can be seen more precisely from FIG. 4, with the roller arrangement being somewhat modified relative to the arrangement of FIG. 2.

FIG. 4 shows a metering apparatus which corresponds essentially to the metering apparatus 12 at the left hand end of FIG. 1. Here however a further roller 88 is provided which supplies the flocks in the chute to the feed rollers 18.1 and 20.1

In this example the roller 18.1 is displaceably executed, the roller 20 however remains fixed (i.e., its axis of rotation not the roller itself). The axle of rotation 66 of the displaceable feed roller 18.1 is also carried here by two arms 72.1 which in this example are not carried by the axle of rotation of the opening roll 22 but rather by the axle of rotation 90 of the additional roller 88. The bias means 76.1 is now arranged on the left hand side of the flock chute and engages, as in the embodiment of FIG. 2 on the arm 72.1

For the sake of a simple representation neither the spring nor the path measuring transducer is shown here, it will however be understood that these units are provided in just the same manner as in the embodiment of FIG. 2. It will also be understood that a further bias means 76.1 is provided at the other end face of the roller 18.1. The feed rollers 18.1 and 20.1 and the further roller 88 are driven by a common motor 92. The drive comprises a chain 94 which is driven by a chain sprocket 96 on the output chute of the motor 92. The chain 94 runs around a chain sprocket 98 provided at the one end face of the roller 88, also around a further chain sprocket 100 provided at the one end face of the roller 20.1 and around a chain sprocket 102 with a tensioning device 104 provided for tensioning the chain. The direction of rotation of the chain is characterized by the arrow 106 from which the desired direction of rotation 28 of the feed roller 20.1 and the direction of rotation 108 of the further roller 88 result. The feed roller 18.1 is driven by a further recirculating chain 110 which is driven by the sprocket 98 which is formed as a double chain sprocket. The chain sprockets 100 and 98 and also the chain sprocket 112 at the one end face of the feed roller 18.1 have the same diameter whereby the speeds of rotation of these rollers are all the same.

The opening roller 22.1 is driven by a separate motor 114 and a recirculating chain 116.

From FIG. 4 one can also see how the opening roll rotates within sheet metal guides 118 and 120, with the sheet metal guide 120 being adjustable in the direction of the double arrow 122 The sheet metal piece 120 forms, together with a further sheet metal piece 124 a guide duct 126 for the fleece of flocks 32. The special shaping of this guide duct 126 shows the flocks after their emergence from the region of the opening roll and guides them gently onto the conveyor band 34 without a pronounced air current arising, which could otherwise possibly disturb the sandwich formation on the transport band.

The reference numeral 128 represents the supply duct by means of which the flocks are pneumatically transported into the chute 14. Finally, the reference numeral 130 represents the computer which controls the speed of the feed rollers via the line 132 and receives via the line 134 the signal of the path measuring transducer which is built into the bias means 76.1.

Figure 5:
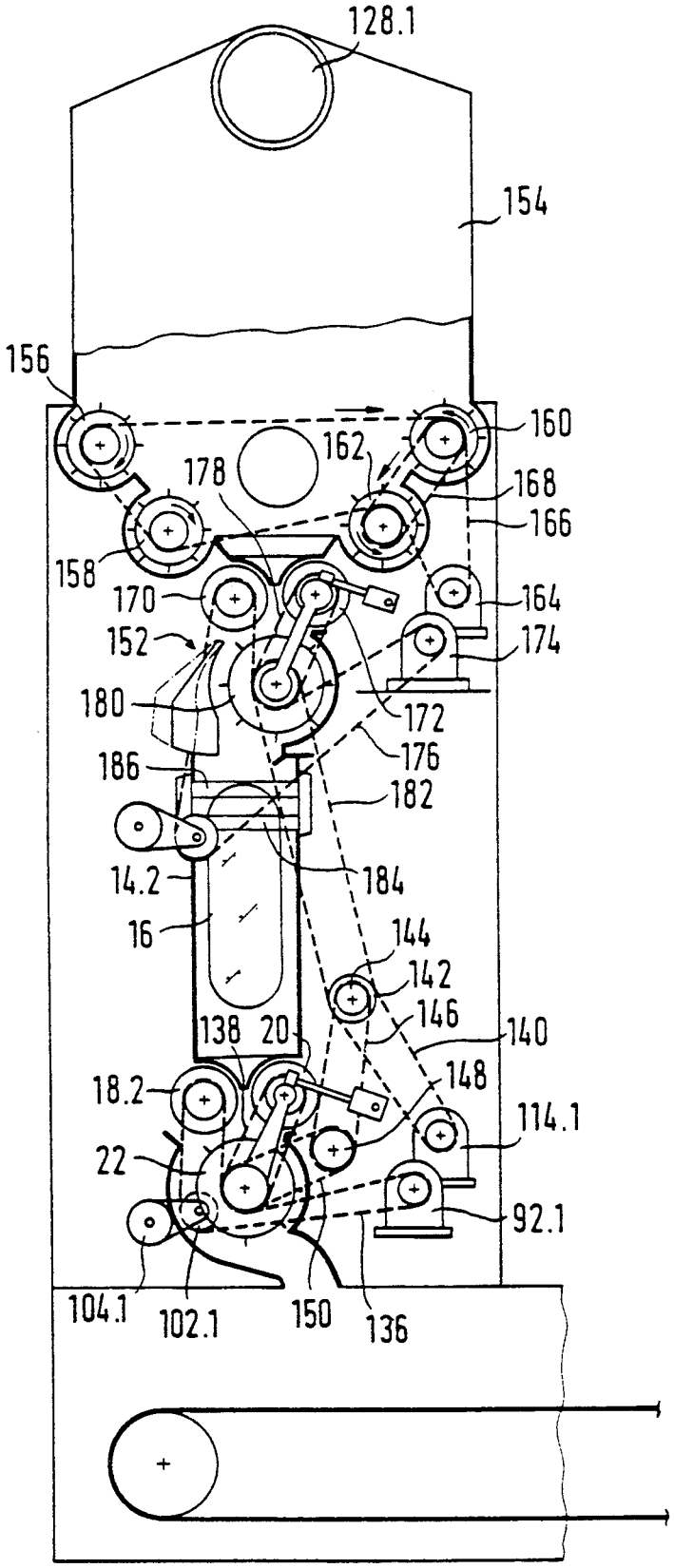
FIG. 5 is a sideview of a further metering apparatus in accordance with the invention.

FIG. 5 shows a further embodiment with the arrangement of the feed rollers 18.2, 20.2 and also of the opening roll 22 being formed in accordance with the arrangement of FIG. 2, which is why these parts are not described in more detail. It should however be pointed out that the motor 92.1 drives the feed roller 18.2 via the recirculating chain 136. This chain is tensioned by the tensioning means 104.1 and the tension wheel 102.1. Three chain sprockets are located on the axle of rotation of the opening roll, with the one chain sprocket being fixedly rotationally connected to the opening roll. The two other chain sprockets are freely rotatable about their axis of rotation but are however coupled together. Of these two,coupled together chain sprockets the one is driven by the recirculating chain !36 and the other drives the feed roller 20.2 via a further recirculating chain 138.

The second motor 114.1 drives, via the chain 140, an intermediate wheel 142 which in turn ultimately drives the opening roll 22 via the chain sprocket which is fixedly rotationally coupled therewith. As seen the arrangement is such that the intermediate wheel 142 drives the opening roll 22 via a further chain sprocket 144 which is coupled therewith, via a recirculating chain 146, via a further double chain sprocket 148 and also via a further recirculating chain 150.

Above the chute 14.2 there is located a further metering device, the task of which is to keep the filling level of the flocks within the chute 14.2 within predeterminable limits. For this purpose flocks are supplied from a buffer chamber 154 to the further metering apparatus 152, and indeed via four feed rollers 156, 158, 160 and 162. These feed rollers 156, 158, 160, 162 can be found from the respective arrows of the drawing. In order to secure these directions of rotation it is necessary to drive the feed roller 160 by the feed roller 162 via a separate chain 168. From this one can see that the recirculating chain 166 is simply guided over a freely rotatably journalled chain sprocket at the feed roller 166.

The metering apparatus 152 is, as already explained, almost identical from the point of view of its construction to the metering apparatus at the lower end of the filling chute 14.2. The drive for the two feed rollers 170, 172 takes place through the motor 174 and indeed via a recirculating chain 176 which is essentially guided in the same way as the chain 136 at the lower end of the conveyor chute, which is why the precise arrangement is not described in more detail. In this case the second feed roller 172 is also driven from a separate recirculating chain 78.

The opening roll 180 is driven from the chain sprocket 142 via a further recirculating chain 182 from which it is evident that the chain sprocket 142 is formed as a double chain sprocket.

Switching on and off of the metering apparatus 152 takes place via the light barriers 184, 186 which determine the upper and lower limits of the filling level. As the chute 14.2 is relatively broad, measured in the direction perpendicular to the plane of the drawing, two light barriers are provided at both sides in order to take account of inclined positions of the upper limit of the filling of flocks. The switching on of the metering apparatus 152 can take place when both lower light barriers are free, the switching off takes place in contrast when both upper light barriers 186 are interrupted.

Different mass flows can also be provided depending on the number of light barriers of the metering apparatus which are covered over. The lowermost light barrier can represent security against running empty whereas the uppermost light barrier can represent a security against overflowing.

Figure 6:
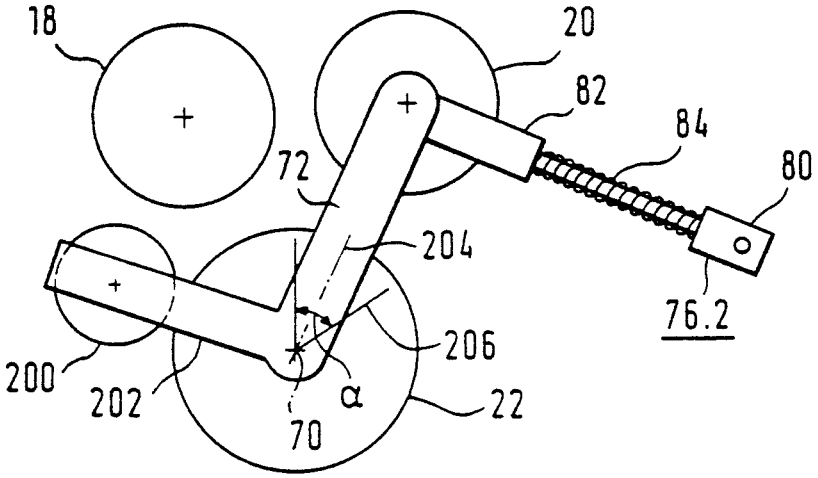
FIGS. 6, 7 and 8 are schematic representations of different embodiments of the bias means.

FIG. 6 shows a schematic representation of a bias means 76.2 for the one feed roller 20, with this bias means being very similar to the bias means 76 of FIG. 2. In the embodiment of FIG. 6 it is however ensured, through clever geometry of the arrangement, through exploiting the feed roller 20 as a compensation weight and through the provision of an additional compensation weight 200, that an at least substantiallv constant bias force is exerted on the mass of flocks 62 between the two feed rollers 18 and 20 in all positions of the feed roller 20 within a predetermined range of pivoting $\alpha$. It will be evident that at the maximum opening angle $\alpha$, i.e., with a position of the arm 72 in which its longitudinal direction 204 is located in the position 206, the spring 84 is more compressed than in the illustrated position, i.e., the bias force exerted by the spring is at a maximum value. On the other hand, the feed roller 20 exerts a larger compressive force on the spring 84 at the maximum angle $\alpha$, since the feed roller 20 then has a larger lever arm for the vertically downwardly directed weight force. The additional compensation weight 200 which exerts a counter-clockwise torque on the arm 72 via the arm 202 in turn generates an additional force in the direction of the spring force 84 towards the fiber flocks which are located between the two feed rollers 18 and 20. This additional force has a relatively small value in the angular position 206. Thus, the bias force exerted on the flocks located between the feed rollers 18 and 20 has a value in the position 206 which corresponds approximately to the difference between the maximum spring force and the maximum value of the weight force of the feed roller 20 which is directed against the spring force.

If in contrast the arm 72 has reached the smallest angular position 208, i.e., $\alpha=0$, then the force of the spring 84 merely has its minimum value and no pronounced counter-force is inserted by the weight of the feed roller 20 on the spring 84. In contrast the additional weight 200 now exerts, as a result of the maximum length of the lever arm for downwardly directed forces, a maximum torque on the arm 72 and this torque assists the force exerted by the spring 84. Thus the force exerted onto the flocks between the two feed rollers corresponds essentially to the difference between the now reduced spring force 84 and the now reduced weight force of the feed roller 20, plus the now increased weight force of the additional weight 200. Through clever choice of the geometry, of the individual weights, of the spring force and of the spring constant one can ensure that the forces exerted on the flocks between the two feed rollers 18 and 20 remains at least substantially constant over the entire angular range $\alpha$.

The equation for the system can be easily derived if one calculates the torques exerted on the arm 72 about the pivot axis 70 as a function of the angle $\alpha$ and then sets this value equal to zero for each angle $\alpha$. The ideal values for the individual rates and also for the spring force and the spring constant can then be derived from these equations. It is however also conceivable that one could attain at least a good approximation to a constant bias force without the auxiliary weight 200.

The arm 72 does not naturally have to be pivotally mounted about the axle of rotation 70 of the opening roll 22. Instead the pivot axis for the arm 72 can be so selected that the clamping force exerted on the flocks remains constant in the desired manner.

Figure 7:
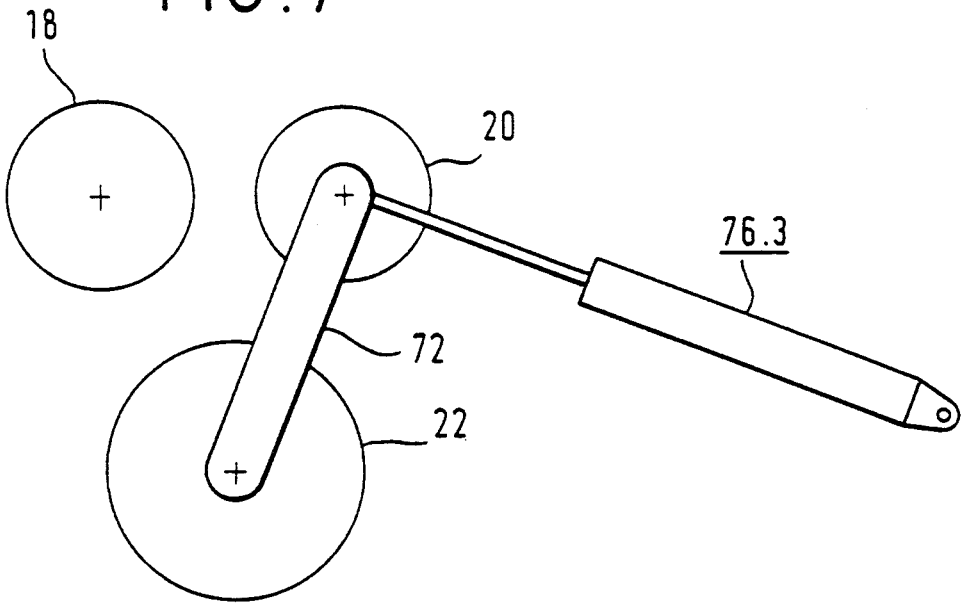

FIG. 7 shows an alternative embodiment of the bias means 76.3 which here takes the form of a gas pressure spring. A gas pressure spring of this kind has the characteristic that it exerts a constant clamping force over a relatively long stroke. It will be appreciated that FIGS. 6 and 7 both show the arrangement at only one end face of the feed rollers 18 and 20 and that this arrangement is duplicated at the other end face of the feed rollers 18 and 20 in corresponding manner.

Figure 8:
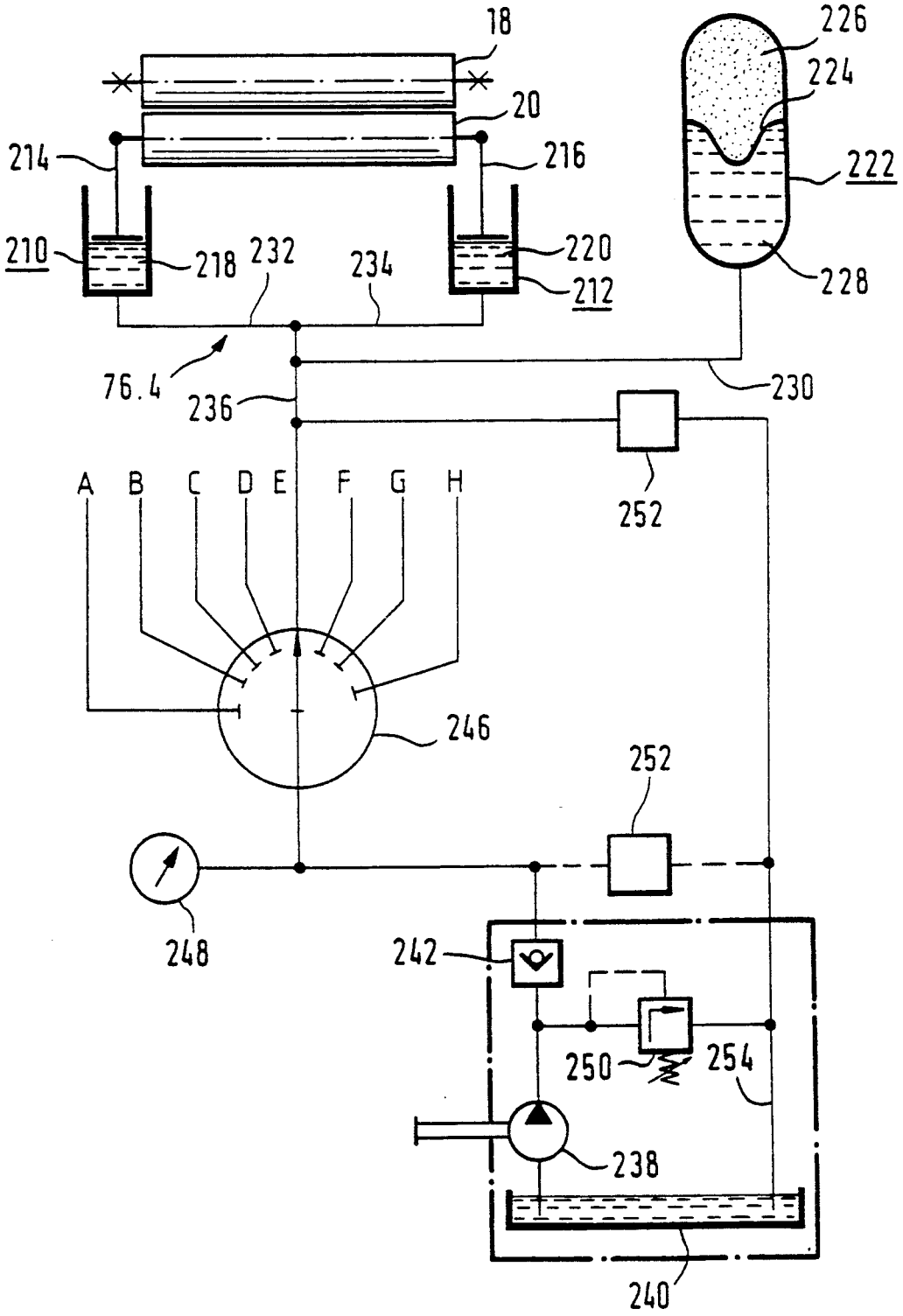

Finally, FIG. 8 shows a hydraulic solution for the task of generating a constant bias force. Here the feed rollers 18 and 20 are also schematically illustrated. In place of the previous spring bias means the bias means 76.4 is formed here by two piston-in-cylinder arrangements 210 and 212 which act on corresponding ends of the axle of the feed roller 20, with for example the piston rods 214, 216 of the two piston-in-cylinder arrangements being pivotally connected to the axle of rotation of the feed roller 20, and with the cylinders 218, 220 of the two piston-in-cylinder arrangements being pivotally connected to the frame of the associated flock chute. In operation a pressure prevails in the two cylinders which is predetermined by the accumulator 222.

The accumulator 222 comprises a cylinder which is subdivided by means of a flexible membrane 224 into two chambers 226 and 228. The chamber 226 is filled with a gas, for example air, whereas the chamber 228 receives a hydraulic liquid which communicates via the lines 230, 232 and 234 with the pressure chambers of the two cylinders 218, 220. Before starting up the metering apparatus an initial pressure is built-up in the hydraulic system, and indeed via a line 236 as will subsequently be explained in more detail. A return flow is however not possible via the line 236 as will likewise be explained later in more detail. As a result of the selected pressure the piston-in-cylinder arrangements 210, 212 exert a predetermined force on the feed roller 20. If the position of the feed roller 20 changes as a result of the flow of flocks which arises then liquid will for example be displaced from the cylinders 218, 220 into the space 228 of the accumulator 222 which leads to an increase of the volume of this space and to a compression of the gas volume 226. So long as the gas volume remains relatively large in comparison to the displaced volumes of liquid, the pressure set in the system remains at least substantially constant so that a constant bias force is exerted on the feed roller 20. This bias force is at least substantially independent of the actual position of the feed roller.

In order to set the system in operation a hand pump is provided in this embodiment and serves to suck hydraulic fluid from a container 240 and to force it via a non-return valve 242 and a distributor valve 226 into the pressure chambers 218, 220 and 228. The pressure established in these pressure chambers can be read off from the manometer 248. A relief valve 250 ensures that the pressure generated by the pump does not exceed a maximum value, for example on failure of the non-return valve 242. A further relief valve 252 prevents an excessive pressure being built-up in the hydraulic pressure system. Should the valve 250 or the valve 252 bring about a pressure relief as a result of an overpressure then the relieved fluid flows via the line 254 back into the container 240.

The distributor valve 246 is so constructed here that the pressure can be built-up at a total of eight different flock chutes A to H with associated metering apparatus (not shown). For each chute there are provided two piston-in-cylinder arrangements 210 and 212 and also an accumulator 222 and the associated lines and pressure relief valves 252. The individual bias means at the chutes A to H can be successively selected via the distribution valve 246. After the pressure has been set in the last chute H in the present example the distributor valve is turned into a closed position in which the connection between the pump 238 and the individual pressure systems is interrupted. It is evident that with this example a separate relief valve 252 must be provided for each pressure system.

It is also possible to operate the system with a small pump 238 which runs constantly. In this case one can do away with the accumulators 222. In place of this the relief valve is so constructed that it maintains a constant pressure. A separate system can be provided for each chute, or all chutes and can be simultaneously connected to one pump and in this case only a single relief valve 252 is necessary for all chutes and functions in this case as a pressure regulating valve. In the latter case all the chutes are connected via a multiway distributor to the pump 238.

What is claimed is:

1. A metering method for dispensing predeterminable quantities of fiber flocks per unit time out of a lower end of a flock chute containing a supply of fiber flocks, the method comprising the steps of:

(a) providing first feed means including a driven feed element located in said lower end of said flock chute and disposed in opposition to second feed means having a surface spaced from said feed element to provide a conveying gap between said feed element and said surface, at least one of the feed means being biased in the direction of the other feed means and being movable away from the latter under the pressure of the flocks;

(b) measuring the spacing (x) between the two feed means, or a value proportional to this spacing; and (c) regulating the speed (n) of said driven feed element as a function of the product (n·x) of said speed and said spacing.

2. Metering method in accordance with claim 1, characterized in that the speed of regulation is so effected that the product (n·x) is integrated over a predeterminable time interval ($t_2$–$t_1$); in that the instantaneous production $$m = \frac{K \int_{t_1}^{t_2} n \cdot x \cdot dt}{t_2 - t_1}$$

is formed herefrom, with K representing a constant; in that a comparison is effected between the actual value m of the instantaneous production and its desired value $m_{des}$; and in that from this a new speed value is calculated for the next time interval in the sense of an approximation of the next value of the instantaneous production to its desired value ($m_{des}$);

3. Metering method in accordance with claim 2, characterized in that said feed means are rollers and in that the speed of rotation n of the feed rollers is regulated within each time interval to a respective constant value.

4. Metering device for dispensing predeterminable quantities of fiber flocks per unit of time for carrying out the method of claim 1, characterized in that said feed means are two feed rollers at the lower end of said chute rotatable in opposite directions and forming a conveying gap therebetween; in that the axis of rotation (68;66.1) of one of said feed rollers (29; 18.1; 172) is mounted for displacement in the direction towards the axis of rotation (66; 68.1) of the other feed roller (18; 20.1; 170) and for displacement away from the latter and is biased in the direction of the rotational axis (66; 68.1) of the other feed roller (18; 20.1; 170); in that a distance measuring device (82, 84) is provided which determines the spacing (x) which results between the two feed rollers in operation of the flock conveyor, or a value proportional to this distance; and in that a regulating device is provided which regulates the speed of rotation (n) of said feed rollers as a result of the distance (x) which is determined in the sense of obtaining a predetermined value for the instantaneous production (m).

5. Metering apparatus in accordance with claim 4, characterized in that the regulation is effected in predeterminable time intervals ($t_2$–$t_1$); in that the instantaneous production (m) given by the integral $$m = \frac{K \int_{t_1}^{t_2} n \cdot x \cdot dt}{t_2 - t_1}$$

is computed for each time interval, with K being a constant; and in that the regulating device carries out a comparison between the instantaneous production (m) and its desired value ($m_{des}$), determines from this the speed of rotation n for the next time interval in the sense of an approximation to the desired value ($m_{des}$) and regulates the speed of rotation to this value.

6. Metering apparatus in accordance with claim 4, characterized in that the axle of rotation of the displaceable feed roller (20, 172) is carried from the axle of rotation of the opening roll (22; 180) or of another roller (88) by means of two arms (72) which are journalled on the axle of rotation of the opening roll or of the other roller respectively.

7. Metering apparatus in accordance with claim 4, characterized in that the bias of the one feed roller in the direction of the other feed roller takes place by means of at least one spring or one biasing element (78), in particular by means of a spring or a biasing element the force of which remains at least substantially constant within the predetermined path of displacement.

8. Metering apparatus in accordance with claim 4, characterized in that the filling height (24) of the flocks provided in the chute is not predetermined.

9. Metering apparatus in accordance with claim 4, characterized in that a means (152) is provided in order to maintain the filling level of the flocks provided in the chute within predeterminable upper and lower limits.

10. Metering apparatus in accordance with claim 6, characterized in that two springs or biasing elements (78) are provided which respectively act on one of the arms (72; 72.1).

11. Metering apparatus in accordance with claim 9, characterized in that exceeding of the upper limit or falling short of the lower limit is detectable by means of light barriers (184, 186).

12. Metering apparatus in accordance with claim 9, characterized in that the means for determining the filling level is provided at the upper end of the chute and flocks are fed into the chute from a chute-like buffer chamber (154) arranged above the device, with the buffer chamber having sieve-like walls.

13. Metering apparatus is accordance with claim 4, characterized in that a plurality of light barriers are arranged at different levels of the flock chute; and in that the respective filling level determined by the light barriers can be taken into account by the regulating means for regulating the speed of rotation of the feed rollers.

14. Metering apparatus in accordance with claim 12, characterized in that the means (152) which determines the filling height is itself a metering apparatus comprising two feed rollers (170, 172) and an opening roll (180).

15. Metering apparatus in accordance with claim 4, characterized in that the feed rollers (18, 20; 18.1, 20.1; 170, 172) have surface configurations for contacting said fiber flocks.

16. Method according to claim 1, including the step of directing the predeterminable quantities of fiber flocks metered by the first and second feed means to an opening roll and then onto a conveyor band which directs the fiber flocks to another opening roll.

17. Metering apparatus for dispensing predeterminable quantities of fiber flocks per unit time out of a lower end of a flock chute containing a supply of fiber flocks, said apparatus comprising:

(a) first feed means including a driven feed element located in said lower end of said flock chute and second feed means disposed in opposition to said feed element and having a surface spaced from said feed element to provided a conveying gap between said feed element and said surface, at least one of the feed means being biased in the direction of the other feed means and being movable away from the latter under the pressure of the flocks;

(b) means for measuring the spacing (x) between the two feed means, or a value proportional to this spacing; and (c) means for regulating the speed (n) of said driven feed element as a function of the product (n·x) of said speed and said spacing.

18. Metering apparatus according to claim 17, wherein said feed element of said first feed means is in the form of a feed roller and said second feed means is in the form of another feed roller.

19. Metering apparatus according to claim 17, including an opening roller located in the lower end of the flock chute and positioned below the first and second feed mean si the direction of fiber flock movement.

20. A metering device for dispensing predeterminable quantities of fiber flocks per unit time out of a lower end of a chute containing a supply of fiber flocks, for carrying out a method comprising the steps of:

(a) providing first feed means including a driven feed element at said lower end of said flock chute and disposed in opposition to second feed means having a surface spaced from said feed element to provided a conveying gap between said feed element and said surface, at least one of the feed means being biased in the direction of the other feed means and being movable away from the latter under the pressure of the flocks;

(b) measuring the spacing (x) between the two feed means, or a value proportional to this spacing; and (c) regulating the speed (n) of said driven feed element as a function of the product (n·x) of said speed and said spacing;

said feed element including a first feed roller and said second feed means including a second feed roller, said first and second feed rollers being located at the lower end of the chute, said first and second feed rollers being rotatable in opposite directions and forming a gap therebetween, an axis of rotation of one of said first and second feed rollers being mounted for displacement in the direction towards and away from an axis of rotation of the other of the first and second feed rollers and being biased in the direction of the axis of rotation of the other of the first and second feed rollers, and including a distance measuring device for determining the spacing (x) or a value proportional thereto which results between the first and second feed rollers during operation of a flock conveyor, a regulating device for regulating the speed of rotation (n) of said feed rollers as a result of the spacing (x) which is determined in the sense of obtaining a predetermined desired value ($m_{des}$) for the instantaneous production (m), and adjustable abutment means for determining the minimum spacing between the first and second feed roller.

21. Metering apparatus in accordance with claim 20, characterized in that the abutment means (86) restrict the range of pivoting of the arms (72; 72.1).

22. A metering device for dispensing predeterminable quantities of fiber flocks per unit time out of a lower end of a chute containing a supply of fiber flocks, for carrying out a method comprising the steps of:

(a) providing first feed means including a driven feed element at said lower end of said flock chute and disposed in opposition to second feed means having a surface spaced from said feed element to provide a conveying gap between said feed element and said surface, at least one of the feed means being biased in the direction of the other feed means and being movable away from the latter under the pressure of the flocks;

(b) measuring the spacing (x) between the two feed means, or a value proportional to this spacing; and (c) regulating the speed (n) of said driven feed element as a function of the product (n·x) of said speed and said spacing;

said feed element including a first feed roller and said second feed means including a second feed roller, said first and second feed rollers being located at the lower end of the chute, said first and second feed rollers being rotatable in opposite directions and forming a gap therebetween, an axis of rotation of one of said first and second feed rollers being mounted for displacement in the direction towards and away from an axis of rotation of the other of the first and second feed rollers and being biased in the direction towards and away from an axis of rotation of the other of the first and second feed rollers and being biased in the direction of the axis of rotation of the other of the first and second feed rollers, and including a distance measuring device for determining the spacing (x) or a value proportional thereto which results between the first and second feed rollers during operation of a flock conveyor, a regulating device for regulating the speed of rotation (n) of said feed rollers as a result of the spacing (x) which is determined in the sense of obtaining a predetermined desired value ($m_{des}$) for the instantaneous production (m), said one of said first and second feed rollers being biased in the direction of said other of said first and second feed roller by way of at least one gas pressure spring.

23. A metering device for dispensing predeterminable quantities of fiber flocks per unit time out of a lower end of a chute containing a supply of fiber flocks, for carrying out a method comprising the steps of:

(a) providing first feed means including a driven feed element at said lower end of said flock chute and opposition to second feed means having a surface spaced from said feed element to provide a conveying gap between said feed element and said surface, at least one of the feed means being biased in the direction of the other feed means and being movable away from the latter under the pressure of the flocks;

(b) measuring the spacing (x) between the two feed means, or a value proportional to this spacing; and (c) regulating the speed (n) of said driven feed element as a function of the product (n·x) of said speed and said spacing;

said feed element including a first feed roller and said second feed means including a second feed roller, said first and second feed rollers being located at the lower end of the chute, said first and second feed rollers being rotatable in opposite directions and forming a gap therebetween, an axis of rotation of one of said first and second feed rollers being mounted for displacement in the direction towards and away from an axis of rotation of the other of the first and second feed rollers and being biased in the direction of the axis of rotation of the other of the first and second feed rollers, including a distance measuring device for determining the spacing (x) or a value proportional thereto which results between the first and second feed rollers during operation of a flock conveyor, and a regulating device for regulating the speed of rotation (n) of said feed rollers as a result of the spacing (x) which is determined in the sense of obtaining a predetermined desired value ($m_{des}$) for the instantaneous production (m), said one of said first and second feed rollers being biased in the direction of said other of said first and second feed rollers by way of at least one spring, and including at least one compensation weight for at least partially compensating for the reduction of the biasing force that results when the spacing between the first and second feed rollers becomes smaller, and a balancing weight, at least a portion of the balancing weight being formed by suspension of one of the first and second feed rollers.

24. A metering device for dispensing predeterminable quantities of fiber flocks per unit time out of a lower end of a chute containing a supply of fiber flocks, for carrying out a method comprising the steps of:

(a) providing first feed means including a driven feed element at said lower end of said flock chute and disposed in opposition to second feed means having a surface spaced from said feed element to provide a conveying gap between said feed element and said surface, at least one of the feed means being biased in the direction of the other feed means and being movable away from the latter under the pressure of the flocks;

(b) measuring the spacing (x) between the two feed means, or a value proportional to this spacing; and (c) regulating the speed (n) of said driven feed element as a function of the product (n·x) of said speed and said spacing;

said feed element including a first feed roller and said second feed means including a second feed roller, said first and second feed rollers being located at the lower end of the chute, said first and second feed rollers being rotatable in opposite directions and forming a gap therebetween, an axis of rotation of one of said first nd second feed rollers being mounted for displacement in the direction towards and away from an axis of rotation of the other of the first and second feed rollers nd being biased in the direction of an axis of rotation of the other of the first and second feed rollers, and including a distance measuring device for determining the spacing (x) or a value proportional thereto which results between the first and second feed rollers during operation of a flock conveyor, and a regulating device for regulating the speed of rotation (n) of said feed rollers as a result of the spacing (x) which is determined in the sense of obtaining a predetermined desired value ($m_{des}$) for the instantaneous production (m), said one of said first and second feed rollers being biased in the direction of said other of said first nd second feed rollers by way of a hydraulic bias means that includes either a displacement system actuated by movement of said one of said first and second feed rollers and an accumulator connected to said displacement system, or a piston-in-cylinder arrangement having a pumping system which generates an at least substantially constant pressure.

25. A metering device for dispensing predeterminable quantities of fiber flocks per unit time out of a lower end of a chute containing a supply of fiber flocks, for carrying out a method comprising the steps of:

(a) providing first feed means including a driven feed element at said lower end of said flock chute and disposed in opposition to second feed means having a surface spaced form said feed element to provide a conveying gap between said feed element and said surface, at least one of the feed means being biased in the direction of the other feed means and being movable away from the latter under the pressure of the flocks;

(b) measuring the spacing (x) between the two feed means, or a value proportional to this spacing, and (c) regulating the speed(n) of said driven feed element as a function of the product (n·x) of said speed and said spacing;

said feed element including a first feed roller and said second feed means including a second feed roller, said first and second feed rollers being located at the lower end of the chute, said first and second feed rollers being rotatable in opposite directions and forming a gap therebetween, an axis of rotation of one of said first and second feed rollers being mounted for displacement in the direction towards and away from an axis of rotation of the other of the first and second feed rollers and being biased in the direction of the axis of rotation of the other of the first and second feed rollers, including a distance measuring device for determining the spacing (x) or a value proportional thereto which results between the first and second feed rollers during operation of a flock conveyor, and a regulating device for regulating the speed of rotation (n) of said feed rollers as a results of the spacing (x) which is determined in the sense of obtaining a predetermined desired value $m_{des}$) for the instantaneous production (m), said one of said first and second feed rollers being biased in the direction of said other of said first and second feed rollers by way of hydraulic means formed by a piston-in-cylinder arrangement having a pumping system which generates an at least substantially constant pressure.

* * * * *